US011460277B2

(12) United States Patent
Kadavanich et al.

(10) Patent No.: US 11,460,277 B2
(45) Date of Patent: Oct. 4, 2022

(54) IGNITER UNIT AND MUNITION

(71) Applicant: Rheinmetall Waffe Munition GmbH, Unterlüß (DE)

(72) Inventors: Vikorn Kadavanich, Bayerisch Gmain (DE); Karl-Friedrich Giebel, Brannenburg (DE)

(73) Assignee: Rheinmetall Waffe Munition GmbH, Unterlüß (DE)

( * ) Notice: Subject to any disclaimer, the term of this patent is extended or adjusted under 35 U.S.C. 154(b) by 0 days.

(21) Appl. No.: 17/289,814

(22) PCT Filed: Sep. 30, 2019

(86) PCT No.: PCT/EP2019/076467
§ 371 (c)(1),
(2) Date: Apr. 29, 2021

(87) PCT Pub. No.: WO2020/088865
PCT Pub. Date: May 7, 2020

(65) Prior Publication Data

US 2021/0396500 A1 Dec. 23, 2021

(30) Foreign Application Priority Data

Oct. 30, 2018 (DE) ..... 10 2018 127 036.4

(51) Int. Cl.
*F42B 5/15* (2006.01)
*F42B 3/10* (2006.01)
(Continued)

(52) U.S. Cl.
CPC ..... *F42B 5/15* (2013.01); *F42B 3/10* (2013.01); *F42B 12/02* (2013.01); *F42C 11/001* (2013.01);
(Continued)

(58) Field of Classification Search
CPC .... F42B 3/10; F42B 3/12; F42B 3/121; F42B 3/122; F42B 5/02; F42B 5/025;
(Continued)

(56) References Cited

U.S. PATENT DOCUMENTS 4,068,592 A * 1/1978 Beuchat ..... F42C 11/04 102/215
5,631,439 A * 5/1997 Sallee ..... F42C 19/00 102/505
(Continued)

FOREIGN PATENT DOCUMENTS

DE 2528544 A1 1/1976
DE 19541647 A1 5/1996
(Continued)

OTHER PUBLICATIONS

International Search Report from corresponding PCT Application No. PCT/EP2019/076467, dated Dec. 12, 2019.

*Primary Examiner* — James S Bergin
(74) *Attorney, Agent, or Firm* — Harness, Dickey & Pierce, P.L.C.

(57) ABSTRACT

The invention relates to an igniter unit for a munition, comprising a housing and at least one pyrotechnic charge, the igniter unit comprising a control and communication device arranged in the housing and at least one interface connected to the control and communication unit and arranged in the housing.

11 Claims, 7 Drawing Sheets

(51) Int. Cl.

| | |
|---|---|
| ***F42B 12/02*** | (2006.01) |
| ***F42C 11/00*** | (2006.01) |
| *F42B 5/02* | (2006.01) |
| *F42B 12/46* | (2006.01) |
| *F42B 35/00* | (2006.01) |

(52) U.S. Cl.
CPC ..... *F42B 5/025* (2013.01); *F42B 12/46* (2013.01); *F42B 35/00* (2013.01)

(58) Field of Classification Search
CPC .. F42B 5/15; F42B 5/155; F42B 12/46; F42B 12/48; F42B 35/00; F42B 4/26; F42B 12/02; F42C 11/00; F42C 11/001; F42C 11/002; F42C 11/065; F42C 19/12; F42C 21/00
USPC ..... 102/202.14, 215
See application file for complete search history.

(56) References Cited

U.S. PATENT DOCUMENTS

| | | | | |
|---|---|---|---|---|
| 6,202,532 | B1 * | 3/2001 | Kadushin | F42C 17/04 89/6 |
| 6,467,414 | B1 | 10/2002 | Fisher | |
| 9,170,070 | B2 * | 10/2015 | Sharpin | F42B 15/01 |
| 10,697,742 | B2 * | 6/2020 | Dube | F42B 5/15 |
| 2011/0146483 | A1 | 6/2011 | Neff | |
| 2021/0404783 | A1 * | 12/2021 | Branch | F41A 17/06 |

FOREIGN PATENT DOCUMENTS

| | | | |
|---|---|---|---|
| DE | 10024464 | A1 | 5/2001 |
| DE | 696 15 709 | T3 | 3/2007 |
| DE | 11 2013 007 339 | T5 | 5/2016 |
| GB | 2472077 | A | 1/2011 |
| WO | WO-03004959 | A2 | 1/2003 |

* cited by examiner

IGNITER UNIT AND MUNITION

CROSS-REFERENCE TO RELATED APPLICATIONS

This application is a national phase application of PCT Application No. PCT/EP2019/076467, filed on 20 Sep. 2019, which claims the benefit of and priority to German Patent Application No. 10 2018 127 036.4, filed on 30 Oct. 2018. The entire disclosures of the applications identified in this paragraph are incorporated herein by references.

FIELD

The invention relates to an igniter unit for a munition comprising a housing and at least one pyrotechnic charge.

The invention also relates to a munition comprising such an igniter unit.

BACKGROUND

Actual charges of munitions, such as decoys or camouflage bodies, are ignited by igniter units that include an impulse cartridge (SQUIB). The impulse cartridges are pyrotechnic charges that cause the ejection from the casing. If the munition is, for example, a decoy or camouflage body, the pyrotechnically acting components (active charges) of the decoy or camouflage body are also ignited in order to form a decoy target. The SQUIBS are typically ignited by a defined current of, for example, 4 A. The function and the design of the SQUIBs and of the igniter units are mostly standardized in order to ensure interoperability. The munition casing and the igniter unit form a unit. After the active charge has been fired, the igniter unit with the munition casing remains in the dispenser system, for example in a launcher or a launcher system.

Igniter units for camouflage and decoy bodies are known, for example, from U.S. Pat. No. 5,631,439 A and from US 2011/0146483 A1.

In the case of camouflage and decoy body munitions, their outer shape is internationally standardized so that different active charges that have the same casing cannot be distinguished in a dispenser system once they have been loaded. This means that there is a considerable risk of incorrect or otherwise ineffective camouflage or decoy bodies being loaded. In the worst case, this can lead to the triggering of a decoy target that is not effective for the current threat but can also lead to malfunctions due to overlapping or overly long storage periods.

If the igniter units, including the munition to be fired, in which they are installed, are loaded in the dispenser, there is, other than a manual inspection, no other way of checking which type of munition is loaded in the dispenser or how old the loaded munition is. For this reason, there are international efforts to create a standardized system for a data exchange between the munition and the dispenser.

SUMMARY

Proceeding from this, the invention is based on the object of creating a data transfer possibility between the dispenser and the loaded munition, which makes it possible to identify the munition loaded in a dispenser.

This object is achieved by the features of claim 1. Furthermore, this object is achieved by the features of claim 10. Advantageous embodiments and developments are the subject matter of the respective subclaims.

According to the invention, an igniter unit for a munition which comprises a housing and at least one pyrotechnic charge, the igniter unit comprising a control and communication device arranged on or in the housing and at least one interface connected to the control and communication unit is created and arranged in the housing.

Furthermore, according to the invention, a munition which comprises such an igniter unit or an igniter unit that was further developed as described below is created.

The housing is preferably a cup-shaped metal part which has an opening that can be closed by a housing base on one side. The housing is preferably a rotationally symmetrical component. The housing has an interior.

The at least one pyrotechnic charge is preferably a conventional pyrotechnic charge that is contained in an impulse cartridge such as a so-called SQUIB. The igniter unit can have such an impulse cartridge.

The control and communication device is designed in such a way that it makes control and communication of the igniter unit possible, for example, via a dispenser system such as a launcher or a launcher system. The control and communication device is designed as an electronic component and preferably comprises at least one chip, which preferably includes a data memory. Furthermore, the control and communication device can include an energy store. Data from the igniter unit such as parts or lot numbers can be stored on the control and communication device. Likewise, data relating to munition connected to the igniter unit can also be stored or already be stored therein in advance. The date of manufacture, the type of munition or active charge, the maximum service life or other munition-related data can be stored, for example, on the control and communication device and retrieved from said device. It is also possible to carry out a functional check of the igniter unit via the control and communication device and to check whether it is still working properly. In addition, the data in the control and communication device can also be noted on the outside of the munition, as has been customary up to now.

The interface is arranged on or within the housing of the igniter unit. All of the electrical and electronic components that are important for the igniter, the storage and the communication are preferably arranged on or within the housing and are thus protected against environmental influences. This protection also provides a higher electromagnetic compatibility (EMC), which prevents interference of the electronics, for example a dispenser.

According to the invention, it can be a wired or a wireless interface, such as a radio interface.

Furthermore, the igniter unit according to the invention can be integrated into different, already existing munitions and can be provided or supplemented with the corresponding munition-related data based on the respective effective charge. The integration of the control and communication unit according to the invention and the interface into the housing of the igniter unit also ensures that no space for the effective charge of the munition is lost within the munition given the existing dimensions.

In addition, the munition is easy to assemble because all electronic components are built into the igniter unit and because these generally do not differ from the existing igniter units with regard to their external dimensions. Furthermore, there are cost advantages because existing igniter units can be supplemented with a control and communication unit as well as the interface.

The igniter unit according to the invention is preferably designed in such a way that it can be integrated, i.e., even downwardly compatible into already existing dispenser systems, in particular counter-measure dispenser systems (CMDS) such as launchers or launcher systems. The igniter unit is preferably designed in such a way that it corresponds to both the mechanical and the electrical conditions of already existing dispenser systems.

In an advantageous development of the igniter unit, it can be provided that the igniter unit comprises a printed circuit board, the printed circuit board being electrically connected to the interface, the control and communication device and the at least one pyrotechnic charge. The interface represents a positive pole. In a preferred embodiment of the igniter unit, it can be provided that the circuit board is electrically connected to the housing. The housing can be the ground (negative pole).

This ensures that the circuit board is designed as a central element to which the further electrical and electronic components are connected. Complex and complicated wiring can thus be dispensed with.

The control and communication device can preferably be formed on the circuit board.

In one embodiment of the igniter unit, it can be provided that the interface is a line-bound interface. Thus, this is an interface that represents an electrical connection within the meaning of a galvanic connection. The interface is preferably designed to form a galvanic connection between the interface and the dispenser. Thus, a galvanic connection is a connection via an electrically conductive material.

The interface can preferably be an ignition contact. In this regard, an advantageous development of the invention makes it possible for the interface to act both as an interface for the control and communication device and as an ignition contact of the igniter unit.

In an advantageous development of the igniter unit, it can be provided that the igniter unit further comprises a Zener diode connected to the circuit board, which is connected to the circuit board, the control and communication device and the at least one pyrotechnic charge in such a way that a communication link below a breakdown voltage of the Zener diode is formed between the interface and the control and communication device. This defines a LOW side that can be controlled via a voltage below the breakdown voltage. The control and communication device can thus be controlled with a voltage below the breakdown voltage. In addition, this voltage can be used to communicate with the control and communication device below the breakdown voltage. The Zener diode is preferably connected in series.

It can also be provided that the communication connection is designed as a bidirectional single-wire connection, and the control and communication device can be operated in a single-wire communication mode below the breakdown voltage of the Zener diode.

The operation below the breakdown voltage creates a LOW side for a communication with the control and communication device via the interface, which allows for a communication with the control and communication device without influencing an ignition on a HIGH side.

The Zener diode connected to the circuit board is preferably connected to the circuit board, the control and communication device and the at least one pyrotechnic charge in such a way that an ignition connection is formed between the interface and the at least one pyrotechnic charge above the breakdown voltage of the Zener diode.

According to an advantageous further development, the interface thus equally forms an ignition contact and a control and communication connection.

Furthermore, it can be provided that the control and communication device, the circuit board, the Zener diode and at least part of the at least one pyrotechnic charge are encapsulated in the housing by a housing base. By means of the encapsulation, the components arranged in the housing are encapsulated in a waterproof and dustproof manner against environmental influences. For this purpose, the igniter unit comprises, for example, at least one seal and/or is sealed with a sealing compound at the points to be sealed.

In one advantageous embodiment, the igniter unit can comprise additional contacts as an interface for the communication of the control and communication device.

Furthermore, in a further development, the igniter unit can comprise an additional interface for effectively charging the munition, via which information relevant to function and effect can be exchanged.

In one advantageous development of the munition, it can be provided that the munition is a decoy, deflector and/or a camouflage body.

Furthermore, it can be provided that a further control and communication device is arranged in a casing of the munition, via which the munition can communicate with the dispenser.

In addition, it is possible that the control and communication device can be formed from more than one component, i.e., for example, a plurality of circuit boards.

BRIEF DESCRIPTION OF THE DRAWINGS

The invention is to be explained below on the basis of exemplary embodiments with reference to the drawings.

The drawings show the following.

DETAILED DESCRIPTION

Figure 1A:
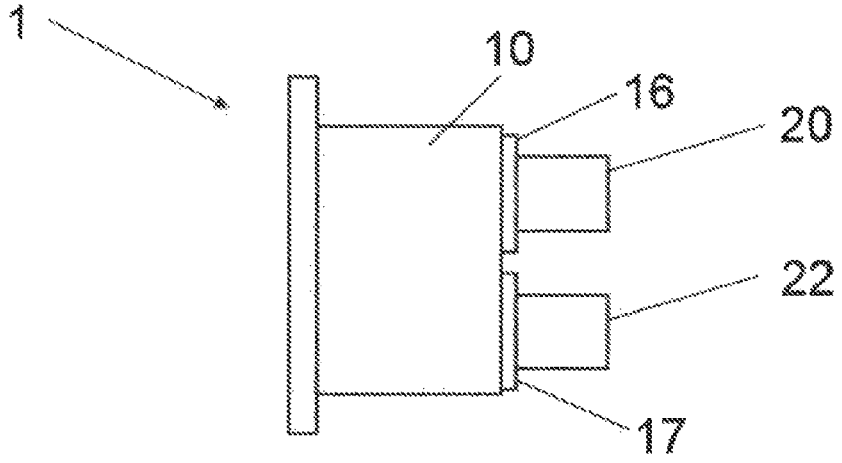
FIG. 1*a* is a schematic side view of an igniter unit according to the invention for a munition according to an embodiment of the invention.

FIG. 1*a* shows a schematic side view of an embodiment of the igniter unit 1 according to the invention. The igniter unit 1 comprises a housing 10 and at least one charge and, in the example here, two pyrotechnic charges 20, 22. It is shaped in a substantially cylindrical manner and comprises a flange on the side opposite the pyrotechnic charges 20, 22.

Figure 1B:
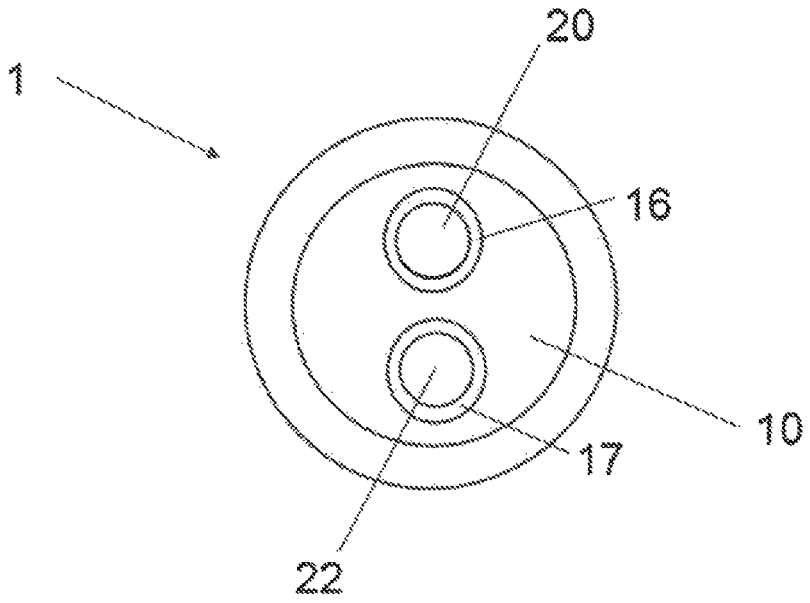
FIG. 1*b* is a schematic bottom view of the igniter unit according to the invention according to FIG. 1*a;*
Figure 2:
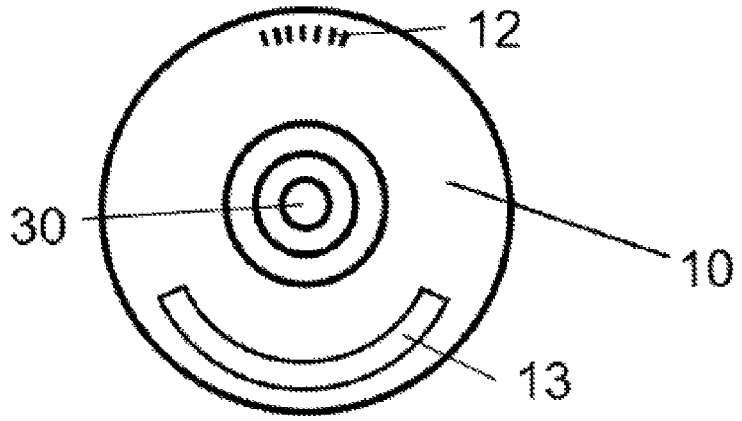
FIG. 2 is a schematic plan view of the igniter unit according to the invention according to FIG. 1*a;*

FIG. 1*b* shows a schematic bottom view of the igniter unit according to the invention from FIG. 1*a*. As can be seen from FIG. 1*b*, the housing 10 is designed to be substantially rotationally symmetrical. The underside of the housing 10 is closed by a housing base 15. The housing base 15 comprises openings through which the pyrotechnic charges 20, 22 extend. In order to seal the housing base 15 against the pyrotechnic charges 20, 22, the seals 16, 17 are arranged in the region of the openings. FIG. 2 shows a schematic top view of the igniter unit 1 according to the invention from FIG. 1*a*. A label 12 and a lot number 13 are arranged on the top of the housing. An interface 30 is arranged in the middle of the top of the housing 10.

Figure 3:
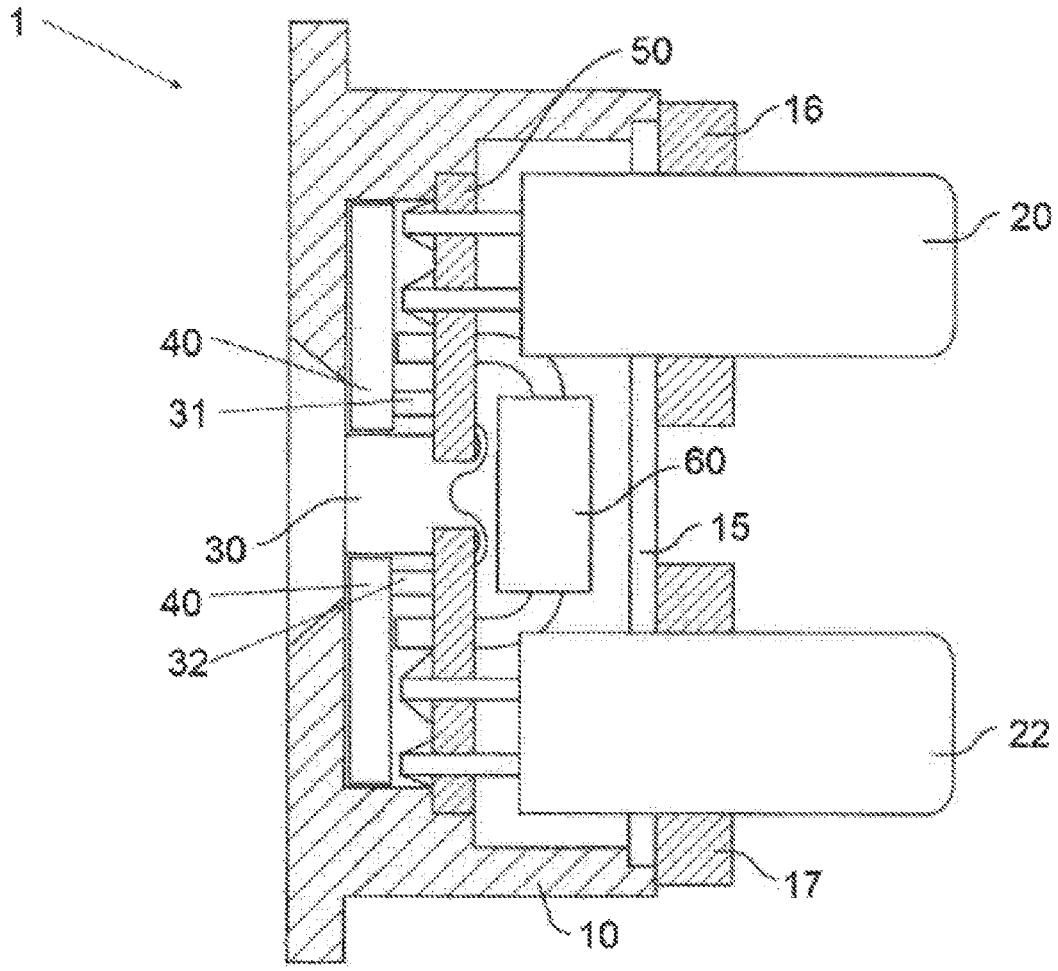
FIG. 3 is a schematic sectional view of the igniter unit according to the invention according to FIG. 1*a;*

FIG. 3 shows a schematic sectional illustration of the igniter unit 1 according to the invention. As already discussed above, the igniter unit 1 has both a housing 10 and at least one pyrotechnic charge 20, 22. In addition, the igniter unit 1 comprises a control and communication device 40 arranged in the housing 10 and at least one interface 30 arranged in the housing 10 and connected to the control and communication unit 40. The control and communication device can be formed from one or more structural units, such as circuit boards.

In the region of the interface 30, the housing 10 comprises an opening so that the interface 30 can be contacted from outside the igniter unit 1.

The igniter unit 1 also comprises a circuit board 50. The circuit board 50 is connected to the interface 30. The interface forms a positive pole. Furthermore, the circuit board 50 is connected to the housing 10. The housing 10 represents the ground and forms a negative pole. To this purpose, the housing is correspondingly coupled to the munition and provided in a dispenser. Furthermore, the pyrotechnic charges 20, 22 are each electrically connected to the circuit board 50.

The control and communication unit 40 is electrically connected to the circuit board 50. The control and communication device 40 is designed in such a way that it allows for the control and communication of the igniter unit 1, for example, via a dispenser system such as a launcher or a launcher system. The control and communication device 40 is designed as an electronic component and comprises at least one chip. Furthermore, the control and communication device 40 can comprise an energy store. At least data from the igniter unit 1 and possibly also from a munition connected to the igniter unit 1 are stored on the control and communication device 40.

The interface 30 is a wired interface and forms an ignition contact for the igniter unit.

The igniter unit 1 comprises a Zener diode 60 which is connected to the circuit board 50. The Zener diode is connected to the circuit board 50, the control and communication device 40 and the pyrotechnic charges 20, 22 in such a way that a communication link is formed between the interface 30 and the control and communication device 40 below a breakdown voltage of the Zener diode 60. This communication connection is designed as a bidirectional single-wire connection. The control and communication device 40 can be operated in a single-wire communication mode below the breakdown voltage of the Zener diode 60.

An ignition connection between the ignition contact 30 and the pyrotechnic charges 20, 22 is formed above the breakdown voltage of the Zener diode 60.

The control and communication device 40, the circuit board 50, the Zener diode 60 and at least some of the two pyrotechnic charges 20, 22 are encapsulated in the housing 10 by a housing base 15.

In order to seal the interior of the housing 10, seals 16, 17 can be arranged in the region of the housing base 15 around the pyrotechnic charges 20, 22.

As shown in FIG. 3, the Zener diode 60 is arranged between the circuit board 50 and the housing base 15. The control and communication device 40 is arranged on the other side of the circuit board. However, it is also conceivable that this arrangement is reversed. It is also possible for the control and communication device 40 to be integrated on the circuit board 15. However, it is also possible that they are distributed over a plurality of structural units such as circuit boards.

Figure 4:
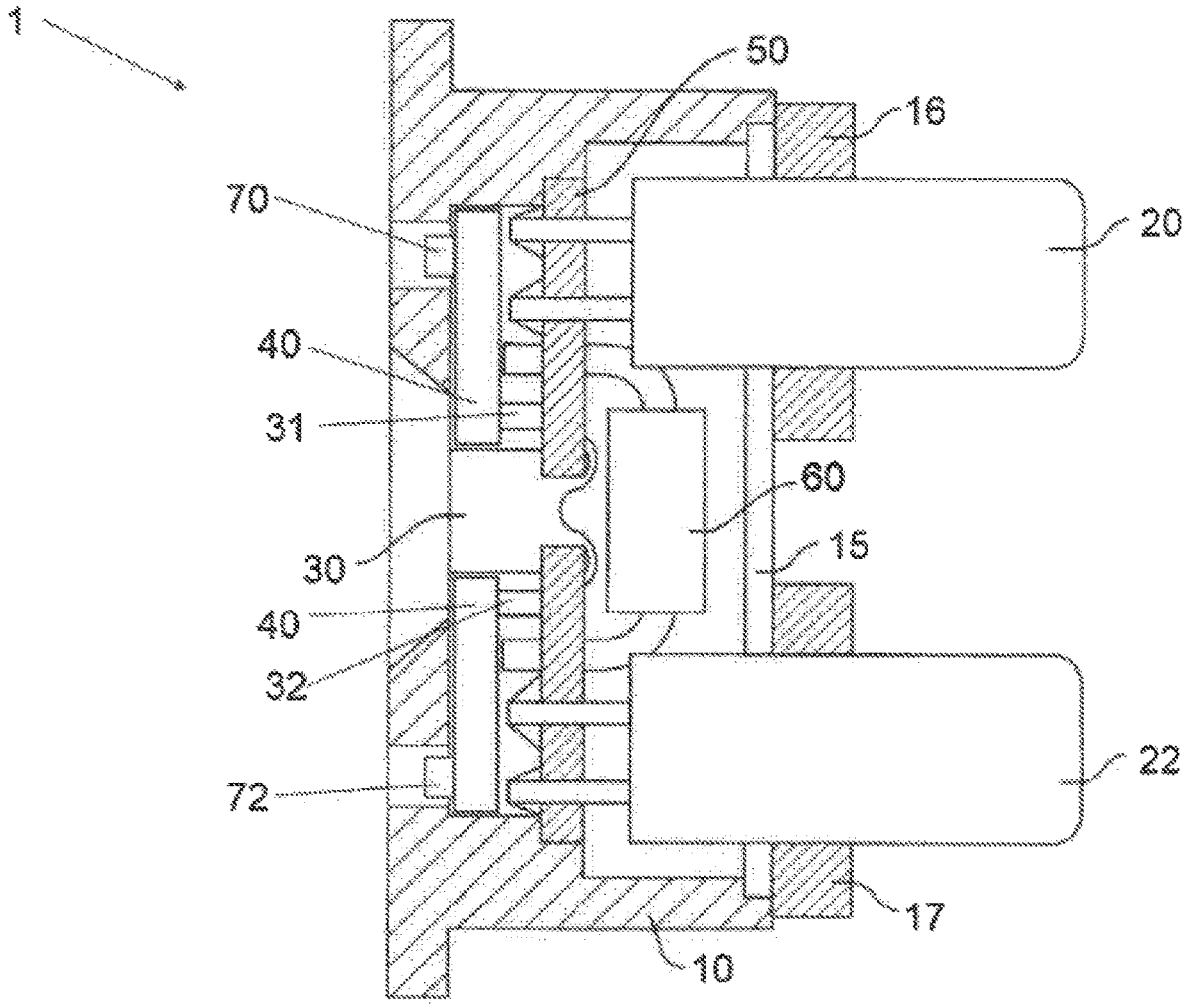
FIG. 4 is a schematic sectional view of an igniter unit according to the invention according to a further embodiment.

FIG. 4 shows a modified embodiment of the igniter unit which is based on the igniter unit according to FIG. 1*a*-3. In addition to the ignition contact, the igniter unit 1 comprises contacts (interfaces) 70, 72 as an interface 30 for forming a control and communication connection with the control and communication device 40. The housing 10 comprises additional openings in the region of the contacts 70, 72 in order to be able to contact them.

Figure 5A:
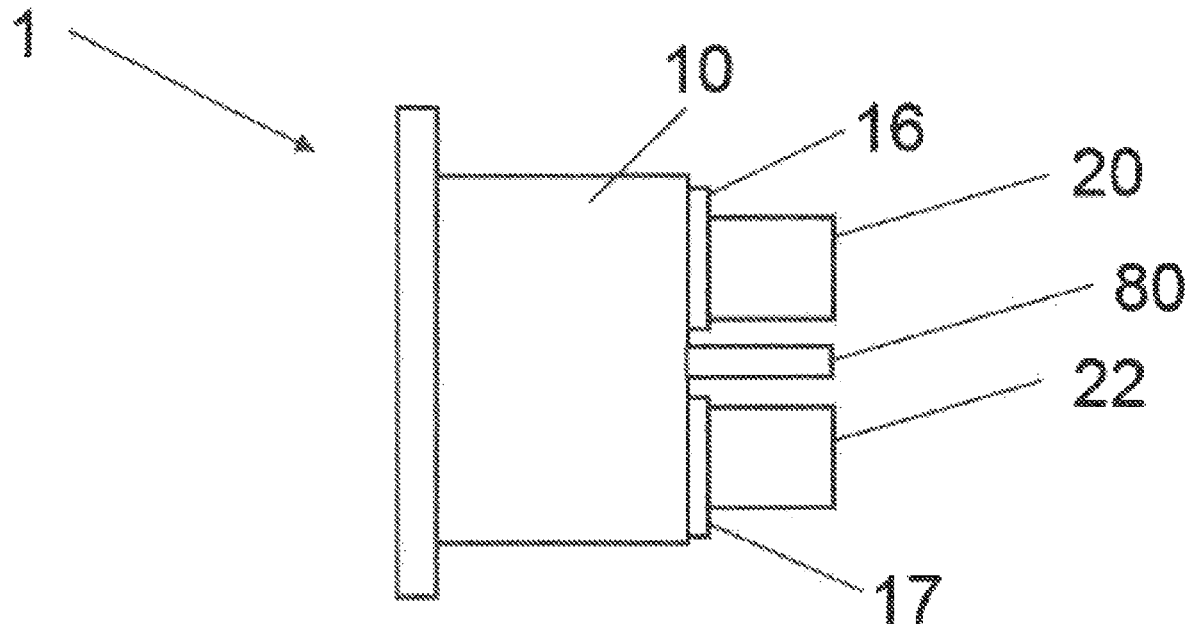
FIG. 5*a* is a schematic side view of an igniter unit according to the invention according to a further embodiment.
Figure 5B:
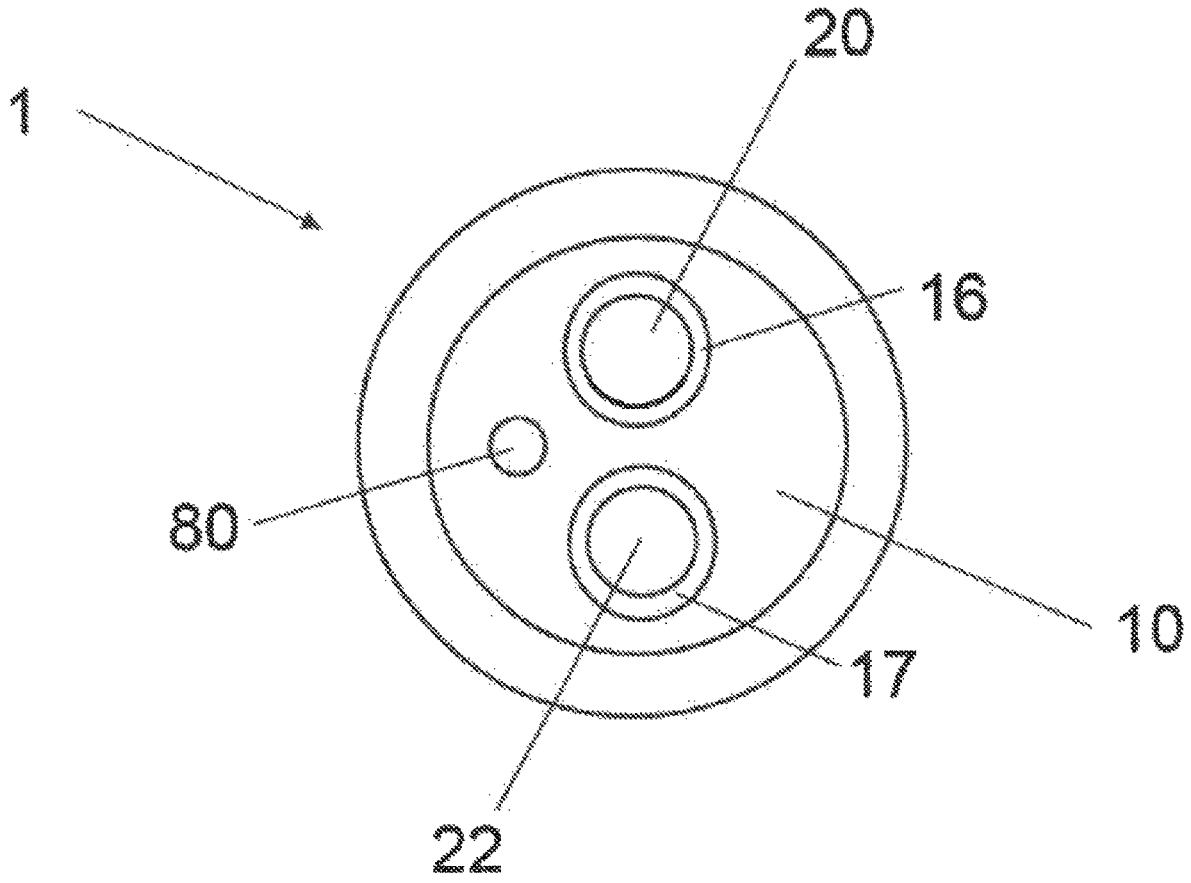
FIG. 5*b* is a schematic bottom view of the igniter unit according to the invention according to FIG. 5*a*.

FIGS. 5*a* and 5*b* show a further modified embodiment of the igniter unit 1, which is based on an igniter unit according to FIG. 1*a*-4. According to FIGS. 5*a* and 5*b*, the igniter unit 1 comprises an additional interface 80 for effectively charging the munition with information relevant to the function and effect being exchangeable via the additional interface 80.

REFERENCE LIST

1 Igniter unit
10 Housing
12 Label
13 Lot number
15 Housing base
16, 17 Seal
20, 22 Pyrotechnic charge
30 Interface
31 Electrical line connection
32 Electrical line connection
40 Control and communication device
50 Circuit board
60 Zener diode
70 Contacts
72 Contacts
80 Additional interface

What is claimed is:

1. An igniter unit for a munition, comprising a housing and at least one pyrotechnic charge, wherein the igniter unit comprises a control and communication device arranged in the housing, at least one interface arranged on or in the housing and connected to the control and communication device, and a Zener diode connected to the control and communication device to form a communication connection, wherein the communication connection is a bidirectional single-wire connection and wherein the control and communication device is configured to operate in a single-wire communication mode below a breakdown voltage of the Zener diode.

2. The igniter unit according to claim 1, wherein the igniter unit comprises a circuit board, wherein the circuit board is electrically connected to the interface, the control and communication device and the at least one pyrotechnic charge.

3. The igniter unit according to claim 2, wherein the interface is an ignition contact.

4. The igniter unit according to claim 3, wherein the Zener diode is connected to the circuit board, the control and communication device and the at least one pyrotechnic charge to form an ignition connection between the ignition contact and the at least one pyrotechnic charge above the breakdown voltage of the Zener diode.

5. The igniter unit according to claim 2, wherein the Zener diode is connected to the circuit board, the control and communication device and the at least one pyrotechnic charge, and wherein the communication connection is formed between the interface and the control and communication device below the breakdown voltage of the Zener diode.

6. The igniter unit according to claim 2, wherein the control and communication device, the circuit board, the Zener diode and at least part of the at least one pyrotechnic charge are encapsulated in the housing by a housing base.

7. The igniter unit according to claim 1, wherein the interface is a wired interface.

8. The igniter unit according to claim 1, wherein the igniter unit comprises additional contacts as an interface for communication with the control and communication device.

9. The igniter unit according to claim 1, wherein the igniter unit comprises an additional interface for effectively charging the munition, via which information relevant to which function and effect can be exchanged.

10. A munition comprising the igniter unit according to claim 1.

11. The munition according to claim 10, wherein the munition is a decoy, deflector or camouflage body.

* * * * *